US008402649B2

(12) United States Patent
Murakami et al.

(10) Patent No.: US 8,402,649 B2
(45) Date of Patent: Mar. 26, 2013

(54) SCROLL MEMBER, METHOD OF MANUFACTURING SAME, COMPRESSION MECHANISM AND SCROLL COMPRESSOR

(75) Inventors: Yasuhiro Murakami, Sakai (JP); Mikio Kajiwara, Sakai (JP); Mitsuhiko Kishikawa, Sakai (JP); Hiroyuki Yamaji, Sakai (JP); Mie Arai, Sakai (JP); Satoshi Yamamoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 741 days.

(21) Appl. No.: 12/593,014

(22) PCT Filed: Mar. 26, 2008

(86) PCT No.: PCT/JP2008/055649

§ 371 (c)(1),
(2), (4) Date: Sep. 25, 2009

(87) PCT Pub. No.: WO2008/120621

PCT Pub. Date: Oct. 9, 2008

(65) Prior Publication Data

US 2010/0111739 A1 May 6, 2010

(30) Foreign Application Priority Data

Mar. 30, 2007 (JP) ..... 2007-092273

(51) Int. Cl.
*B23P 15/00* (2006.01)

(52) U.S. Cl. ..... 29/888.022; 418/55.1; 164/47

(58) Field of Classification Search ..... 164/47; 29/888.02, 888.022; 418/55.1–55.6
See application file for complete search history.

(56) References Cited

U.S. PATENT DOCUMENTS

| | | | | | |
|---|---|---|---|---|---|
| 3,994,635 | A | * | 11/1976 | McCullough | 418/55.4 |
| 4,726,100 | A | * | 2/1988 | Etemad et al. | 29/888.022 |
| 4,834,633 | A | * | 5/1989 | Etemad et al. | 418/1 |
| 5,591,018 | A | * | 1/1997 | Takeuchi et al. | 417/366 |
| 5,711,659 | A | | 1/1998 | Fukanuma et al. | |
| 5,730,588 | A | | 3/1998 | Terai et al. | |
| 6,079,962 | A | * | 6/2000 | Seibel et al. | 418/55.2 |
| 6,086,341 | A | * | 7/2000 | Fukuhara et al. | 418/55.2 |
| 6,132,192 | A | * | 10/2000 | Mitsunaga et al. | 418/55.2 |
| 2006/0159580 | A1 | * | 7/2006 | Matsuhashi | 418/55.2 |

FOREIGN PATENT DOCUMENTS

| | | | |
|---|---|---|---|
| JP | 09-004576 | A | 1/1997 |
| JP | 09-079150 | A | 3/1997 |
| JP | 10-082381 | A | 3/1998 |
| JP | 2002-070767 | A | 3/2002 |
| JP | 2002-312420 | A | 10/2002 |
| JP | 2003-336585 | A | 11/2003 |
| JP | 2005-036693 | A | 2/2005 |

* cited by examiner

*Primary Examiner* — David Bryant
*Assistant Examiner* — Jacob Cigna
(74) *Attorney, Agent, or Firm* — Global IP Counselors

(57) ABSTRACT

A method of manufacturing a scroll member includes a casting step and a cutting step. In the casting step an iron casting having a spiraling part is formed. In the cutting step, the iron casting obtained in the casting step is cut to obtain a final shape of the scroll member. Preferably the iron casting obtained in the casting step has a fixing part with the spiraling part extending from one side and a protruding part extending from an opposite side. A specified portion of the spiraling part, a central portion of the fixing part and/or the protruding part has a larger dimension before the cutting step is performed than after the cutting step is performed.

13 Claims, 10 Drawing Sheets

SCROLL MEMBER, METHOD OF MANUFACTURING SAME, COMPRESSION MECHANISM AND SCROLL COMPRESSOR

CROSS-REFERENCE TO RELATED APPLICATIONS

This U.S. National stage application claims priority under 35 U.S.C. §119(a) to Japanese Patent Application No. 2007-092273 filed in Japan on Mar. 30, 2007, the entire contents of which are hereby incorporated herein by reference.

TECHNICAL FIELD

The present invention relates to a scroll member and a method for manufacturing the same.

BACKGROUND ART

A scroll-type compressor comprises a compression mechanism for compressing a refrigerant. The compression mechanism has a fixed scroll and an orbiting scroll.

Methods for forming cast iron by using a metal die, for example, have been used conventionally as methods for manufacturing fixed scrolls, orbiting scrolls, and other scroll members. In conventional methods, the cast iron has been formed into substantially the same shape as the finished products of scroll members (see Japanese Laid-open Patent Application No. 2005-36693, for example).

SUMMARY OF THE INVENTION

Technical Problem

However, if the cast iron is formed into the same shape as the finished products of the scroll members, the portion extending in a spiraling formation of low thickness is easy to cool due to a low heat capacity, and the hardness cannot be increased. Therefore, when the compression mechanism is driven, there is a danger that this portion will suffer wear or deformation.

The strength of this portion can be increased by increasing the thickness of this portion, but this is undesirable because the size of the compression mechanism is increased.

The present invention is made in view of the circumstances described above, and an object thereof is to reduce wear and deformation in a scroll member.

Solution to Problem

A method for manufacturing a scroll member according to a first aspect of the present invention is a method for manufacturing a scroll member used in a compression mechanism installed in a scroll compressor, the method comprising a step (a) and a step (b). In step (a), cast iron is formed and an iron casting is obtained, the iron casting having a spiraling part extending in a spiraling formation. In step (b), the iron casting obtained in step (a) is cut and a scroll member is obtained. The iron casting obtained in step (a) is designed so that a dimension in a specified portion of the spiraling part is greater than the dimension of the same portion after step (b) is performed. The specified portion is positioned at least at an end near a center of the spiral.

A method for manufacturing a scroll member according to a second aspect of the present invention is the method for manufacturing a scroll member according to the first aspect, wherein the specified portion is a portion of the spiraling part which extends around the center from the end to a position located anywhere from a half circle up to a full circle.

A method for manufacturing a scroll member according to a third aspect of the present invention is the method for manufacturing a scroll member according to the first or second aspect, wherein the compression mechanism includes two scroll members, one being an orbiting scroll and the other being a fixed scroll provided with a hole in the center. In the orbiting scroll, the specified portion after step (b) is performed encircles the hole of the fixed scroll when the orbiting scroll has been incorporated into the compression mechanism.

A method for manufacturing a scroll member according to a fourth aspect of the present invention is the method for manufacturing a scroll member according to any of the first through third aspects. The scroll member is a fixed scroll provided with a hole in the center. In the fixed scroll, the specified portion after step (b) is performed encircles the hole.

A method for manufacturing a scroll member according to a fifth aspect of the present invention is the method for manufacturing a scroll member according to any of the first through fourth aspects, wherein the dimension is the thickness of the spiraling part.

A method for manufacturing a scroll member according to a sixth aspect of the present invention is the method for manufacturing a scroll member according to the fifth aspect, wherein the iron casting obtained in step (a) further includes a fixing part for fixing the spiraling part. The height of the specified portion from the fixing part is greater than the height after step (b) is performed.

A method for manufacturing a scroll member according to a seventh aspect of the present invention is the method for manufacturing a scroll member according to any of the first through fourth aspects, wherein the iron casting obtained in step (a) further includes a fixing part for fixing the spiraling part. The dimension is the height of the spiraling part from the fixing part.

A method for manufacturing a scroll member according to an eighth aspect of the present invention is the method for manufacturing a scroll member according to the fifth or sixth aspect, wherein the iron casting obtained in step (a) further includes a fixing part for fixing the spiraling part. In the specified portion, the dimension of a base portion fixed to the fixing part is greater than the dimension after step (b) is performed.

A method for manufacturing a scroll member according to a ninth aspect of the present invention is the method for manufacturing a scroll member according to the eighth aspect, wherein the dimension of the base portion decreases towards a distal end of the spiraling part as viewed from the fixing part.

A method for manufacturing a scroll member according to a tenth aspect of the present invention is the method for manufacturing a scroll member according to the ninth aspect, wherein the dimension of a portion near the distal end in the specified portion is also greater than the dimension after step (b) is performed. The thickness of the spiraling part decrease towards the distal end from the base.

A method for manufacturing a scroll member according to an eleventh aspect of the present invention is the method for manufacturing a scroll member according to the tenth aspect, wherein a side surface of the spiraling part is a flat surface in both the base portion and the portion near the distal end. The side surface of the base portion is inclined with respect to the side surface of the portion near the distal end.

A method for manufacturing a scroll member according to a twelfth aspect of the present invention is the method for manufacturing a scroll member according to any of the eighth through eleventh aspects, wherein the base portion of the specified portion, the portion near the distal end, and the portion of the fixing part in the spiraling part side are all cut in step (b). The thickness at which the base portion is cut is greater than both of the thicknesses with which the portion near the distal end and the portion of the fixing part are cut.

A method for manufacturing a scroll member according to a thirteenth aspect of the present invention is a method for manufacturing a scroll member used in a compression mechanism installed in a scroll compressor, the method comprising a step (a) and a step (b). In step (a), cast iron is formed and an iron casting is obtained having a spiraling part extending in a spiraling formation and a fixing part for fixing the spiraling part. In step (b), the iron casting obtained in step (a) is cut and the scroll member is obtained. The iron casting obtained in step (a) is designed so that in the fixing part, a thickness of the portion near a center of the spiral is greater than the thickness of the same portion after step (b) is performed.

A method for manufacturing a scroll member according to a fourteenth aspect of the present invention is the method for manufacturing a scroll member according to the thirteenth aspect, wherein the iron casting obtained in step (a) has a protruding part fixed to the fixing part on the side opposite the spiraling part. The protruding part extends in a cylindrical shape from the edge of the portion near the center of the fixing part towards the side opposite the spiraling part.

A method for manufacturing a scroll member according to a fifteenth aspect of the present invention is a method for manufacturing a scroll member used in a compression mechanism installed in a scroll compressor, the method comprising a step (a) and a step (b). In step (a), cast iron is formed and an iron casting is obtained having a spiraling part extending in a spiraling formation, a fixing part for fixing the spiraling part, and a protruding part fixed near a center of the fixing part on the side opposite the spiraling part. In step (b), the protruding part of the iron casting obtained in step (a) is cut into a cylindrical shape open only in the side opposite the spiraling part.

A method for manufacturing a scroll member according to a sixteenth aspect of the present invention is the method for manufacturing a scroll member according to any of the first through fifteenth aspects, wherein the cast iron is formed by semi-molten die casting in step (a).

A scroll member according to a seventeenth aspect of the present invention is the scroll member (26) manufactured by the method according to any of the first through sixteenth aspects. After step (b) is performed, the ratio of the height of the spiraling part from the fixing part with respect to the thickness of the spiraling part is 8.5 or greater.

A scroll member according to an eighteenth aspect of the present invention is the scroll member according to the seventeenth aspect, wherein the hardness of the base portion fixed to the fixing part is HRB 95 or greater in the portion near the end at the center of the spiral in the spiraling part.

A compression mechanism according to a nineteenth aspect of the present invention comprises the scroll member according to the seventeenth or eighteenth aspect as either one or both of an orbiting scroll and a fixed scroll.

A scroll compressor according to a twentieth aspect of the present invention comprises the compression mechanism according to the nineteenth aspect.

A scroll compressor according to a twenty-first aspect of the present invention is the scroll compressor according to the twentieth aspect, wherein refrigerant including carbon dioxide as a main component is compressed.

Advantageous Effects of Invention

With the method for manufacturing a scroll member according to the first aspect, the dimension of the end portion at the center of the spiral in step (a) is made to be larger than the dimension after step (b) is performed, whereby the heat capacity is increased in the end portion where stress readily concentrates. Consequently, this end portion is resistant to cooling even after being formed. The hardness of this portion can thereby be increased, and wear in the scroll member can thereby be reduced.

With the method for manufacturing a scroll member according to the second aspect, the hardness can be increased in the portion where stress readily concentrates near the center. Consequently, wear in the scroll member can be reduced.

With the method for manufacturing a scroll member according to the third aspect, the hardness can be increased in the portion where stress readily concentrates near the hole. Consequently, wear in the orbiting scroll can be reduced.

With the method for manufacturing a scroll member according to the fourth aspect, the hardness can be increased in the portion where stress readily concentrates near the hole. Consequently, wear in the fixed scroll can be reduced.

With the method for manufacturing a scroll member according to the fifth aspect, the hardness of the spiraling part can be increased.

With the method for manufacturing a scroll member according to the sixth or seventh aspect, it is possible to increase the hardness of the portion at the distal end of the spiraling part when the spiraling part is viewed from the fixing part.

With the method for manufacturing a scroll member according to the eighth aspect, the thickness of the base portion of the specified portion is made to be greater than the thickness after step (b) is performed, whereby the heat capacity is increased in the base portion where stress readily concentrates. Consequently, the base portion is resistant to cooling even after being formed. The hardness of the base portion can thereby be increased, and deformation in the spiraling part after machining can thereby be prevented.

With the method for manufacturing a scroll member according to the ninth aspect, the thickness of the base portion decreases towards the distal end, whereby the iron casting is easily removed from the metal die in the direction opposite the distal end in cases in which the iron casting is formed using a metal die in step (a). This is because friction is reduced between the metal die and the base portion of the spiraling part.

With the method for manufacturing a scroll member according to the tenth aspect, the iron casting is easily removed from the metal die. Moreover, since the thickness of the portion near the distal end is small, a smaller amount is cut in comparison with the base portion, and machining of the iron casting is thereby made easier.

With the method for manufacturing a scroll member according to the eleventh aspect, since the side surface of the spiraling part has a tapered shape, it is even easier to remove the iron casting from the metal die.

With the method for manufacturing a scroll member according to the twelfth aspect, the heat capacity of the base portion can be made greater than the heat capacity of the other portions because the iron casting obtained in step (a) is designed so that the dimension of the base portion of the spiraling part is greater than the dimensions of the portion near the distal end of the specified portion and the portion on the spiraling part side of the fixing part. Consequently, the hardness of the base portion can be made greater than the other portions.

With the method for manufacturing a scroll member according to the thirteenth aspect, the thickness of the portion near the center of the fixing part in step (a) is made greater than the thickness after step (b) is performed, whereby the heat capacity of this portion is increased. Consequently, this portion is resistant to cooling even after being formed, and the portion of the spiraling part near the center is resistant to cooling. The hardness of the portion near the center of the spiraling part can thereby be increased, and wear in the scroll member can be reduced.

With the method for manufacturing a scroll member according to the fourteenth aspect, the scroll member can be used as an orbiting scroll. The protruding part is used as a bearing, and slidably supports the crankshaft for rotating the orbiting scroll.

With the method for manufacturing a scroll member according to the fifteenth aspect, the protruding part is also formed in step (a), whereby the iron casting is thicker near the center. Consequently, the center vicinity of the iron casting is increased in heat capacity and more resistant to cooling even after being formed, and the portion near the center in the spiraling part is thereby resistant to cooling. The hardness of the portion near the center of the spiraling part can thereby be increased, and wear in the scroll member can be reduced. Moreover, the scroll member can be used as an orbiting scroll by performing step (b). The protruding part after machining is used as a bearing, and slidably supports the crankshaft for rotating the orbiting scroll.

With the method for manufacturing a scroll member according to the sixteenth aspect, the strength of the resulting scroll member is increased by using semi-molten die casting.

With a scroll member according to the seventeenth aspect, since the scroll member is manufactured by the method of any of first through sixteenth aspects, the spiraling portion has high strength, and the spiraling part is thereby resistant to deformation even if the ratio of height to thickness is 8.5 or greater. Consequently, the scroll member can be reduced in size.

With the scroll member according to the eighteenth aspect, the strength of the base portion of the portion near the center can be increased to HRB 95 or greater, and strength can be increased by semi-molten die casting. Therefore, damage in the spiraling part due to stress can be prevented even if the ratio of height to thickness in the spiraling part is 8.5 or greater.

With the compression mechanism according to the nineteenth aspect, damage in the spiraling part due to stress can be prevented because the hardness and strength of the portion near the center of the spiraling part are higher than those of the other portions. Consequently, the compression mechanism does not fail readily.

With the scroll compressor according to the twentieth aspect, since the compression mechanism does not readily fail, the scroll compressor also does not readily fail.

With the scroll compressor according to the twenty-first aspect, since the compression mechanism has high strength, the scroll compressor does not readily fail even in cases in which carbon dioxide is used.

DETAILED DESCRIPTION OF THE INVENTION

Figure 1:
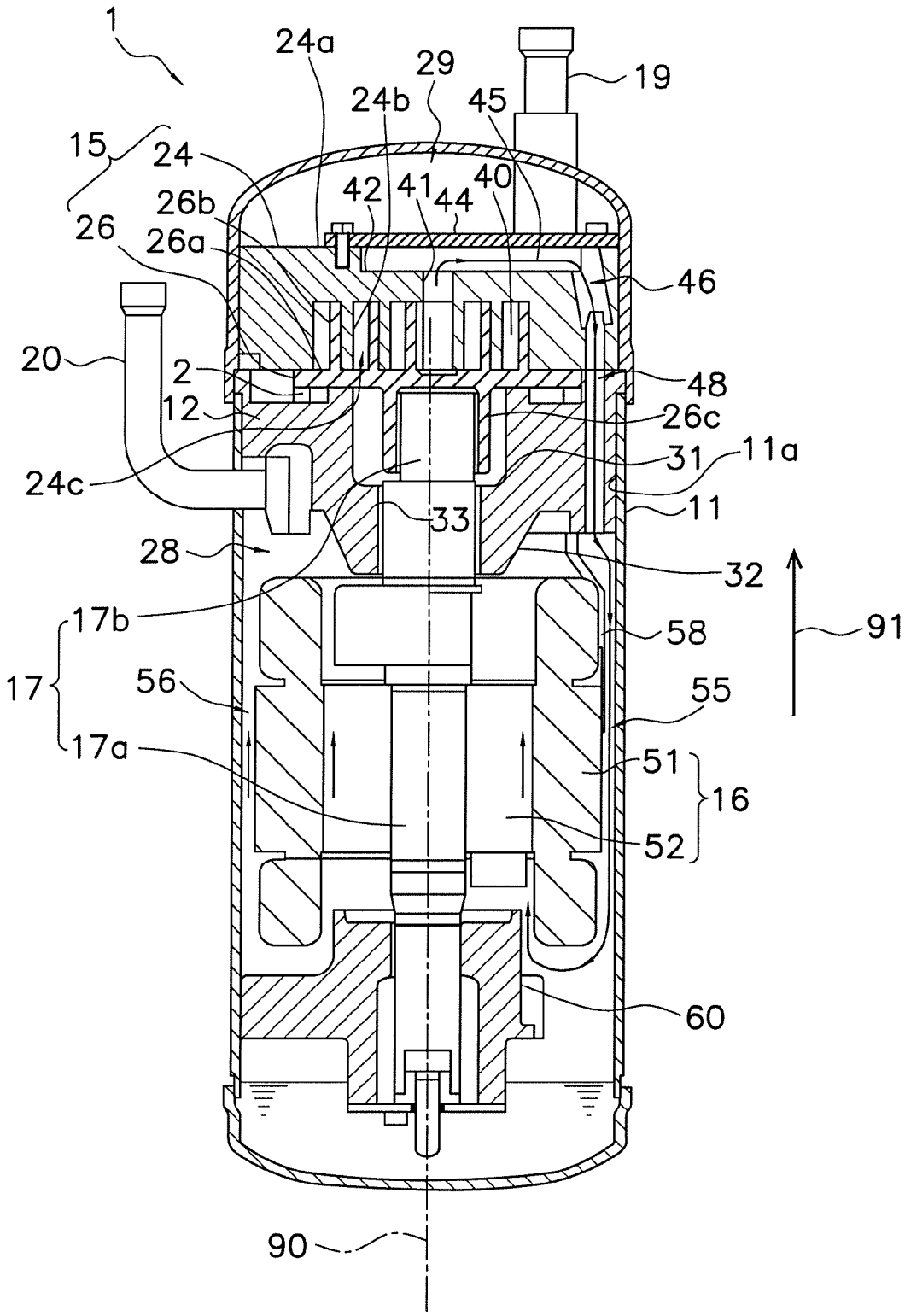
FIG. 1 is a drawing schematically depicting a scroll compressor 1 according to an embodiment of the present invention.

FIG. 1 is a drawing schematically depicting a scroll compressor 1 according to an embodiment of the present invention. A direction 91 is shown in FIG. 1, and hereinbelow the distal side of the arrow of the direction 91 is referred to as "upper side," while the opposite side is referred to as "lower side."

The scroll compressor 1 comprises a case 11 and a compression mechanism 15. The case 11 has a cylindrical shape and extends along the direction 91. The compression mechanism 15 is housed within the case 11.

The compression mechanism 15 has a fixed scroll 24 and an orbiting scroll 26 and compresses refrigerant. A refrigerant containing, e.g., carbon dioxide as a primary component can be used. Both the fixed scroll 24 and the orbiting scroll 26 can be conceived as the scroll member used in the compression mechanism 15.

The fixed scroll 24 includes a panel 24*a* and a compression member 24*b*. The panel 24*a* is fixed to an internal wall 11*a* of the case 11, and the compression member 24*b* is linked to the underside of the panel 24*a*. The compression member 24*b* extends in a spiraling shape, and a groove 24*c* is formed along the spiral therein. A hole 41 is provided in the central vicinity of the panel 24*a*. Refrigerant compressed by the compression mechanism 15 is discharged through the hole 41.

The orbiting scroll 26 has a panel 26*a* and a compression member 26*b*. The compression member 26*b* is linked to the top side of the panel 26*a* and extends in a spiraling formation.

The compression member 26*b* is accommodated within the groove 24*c* of the fixed scroll 24. In the compression mechanism 15, a space 40 between the compression member 24*b* and the compression member 26*b* is hermetically sealed by the panels 24*a*, 26*a* and is thereby used as a compression chamber.

In relation to the method for manufacturing a scroll member, the method for manufacturing the orbiting scroll 26 is described hereinbelow in the first and second embodiments, and the method for manufacturing the fixed scroll 24 is described in the third embodiment. In the fourth embodiment, the scroll members obtained by the above manufacturing methods are described.

First Embodiment

The method for manufacturing the orbiting scroll 26, which is a scroll member, comprises a step (a) and a step (b).

In step (a), cast iron is formed and an iron casting is obtained. For example, an iron casting of high strength can be obtained by forming cast iron by semi-molten die casting. In step (b), the iron casting obtained in step (a) is cut to obtain the orbiting scroll 26.

Figure 2:
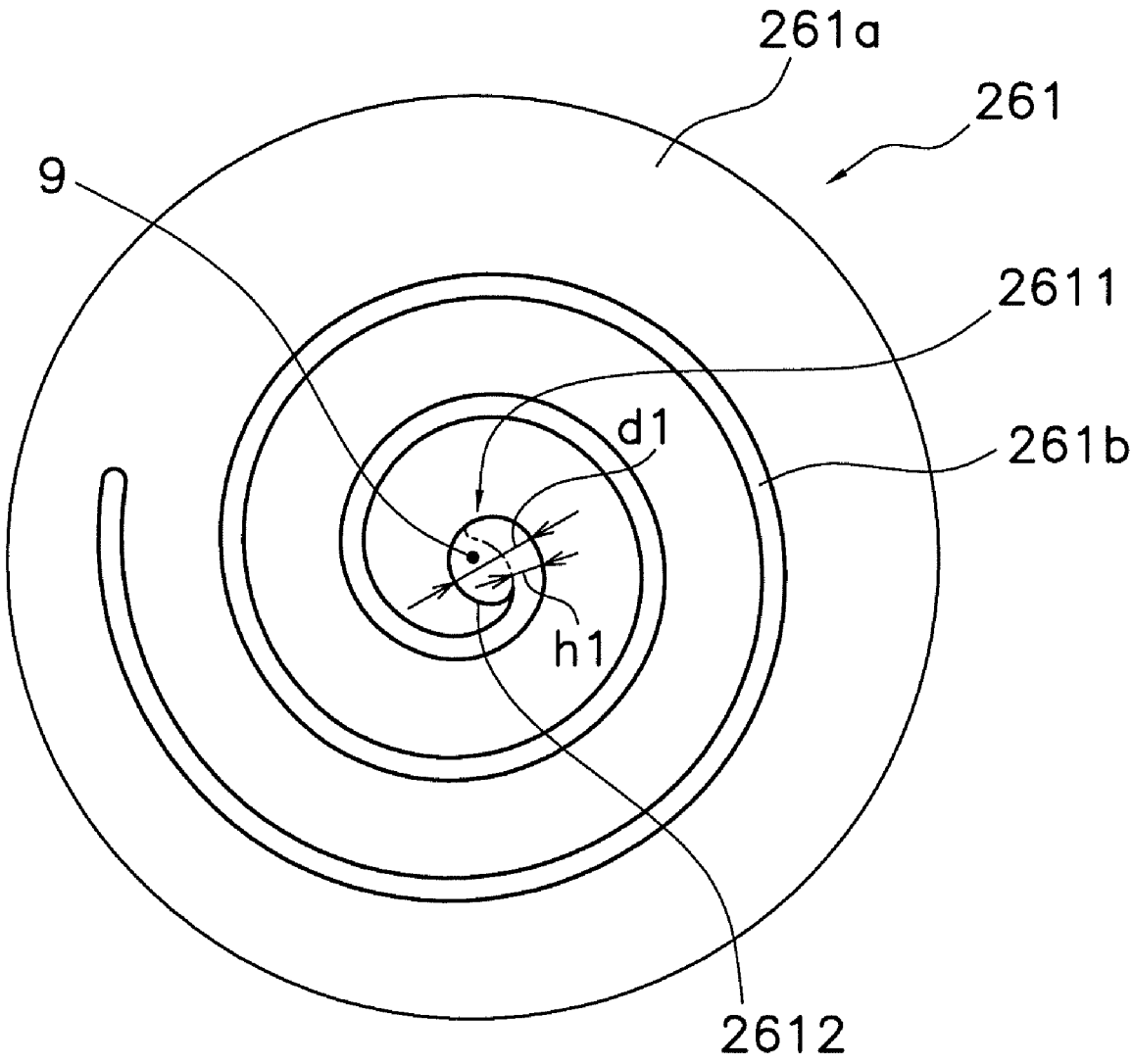
FIG. 2 is a drawing schematically depicting an iron casting 261 obtained in step (a).
Figure 3:
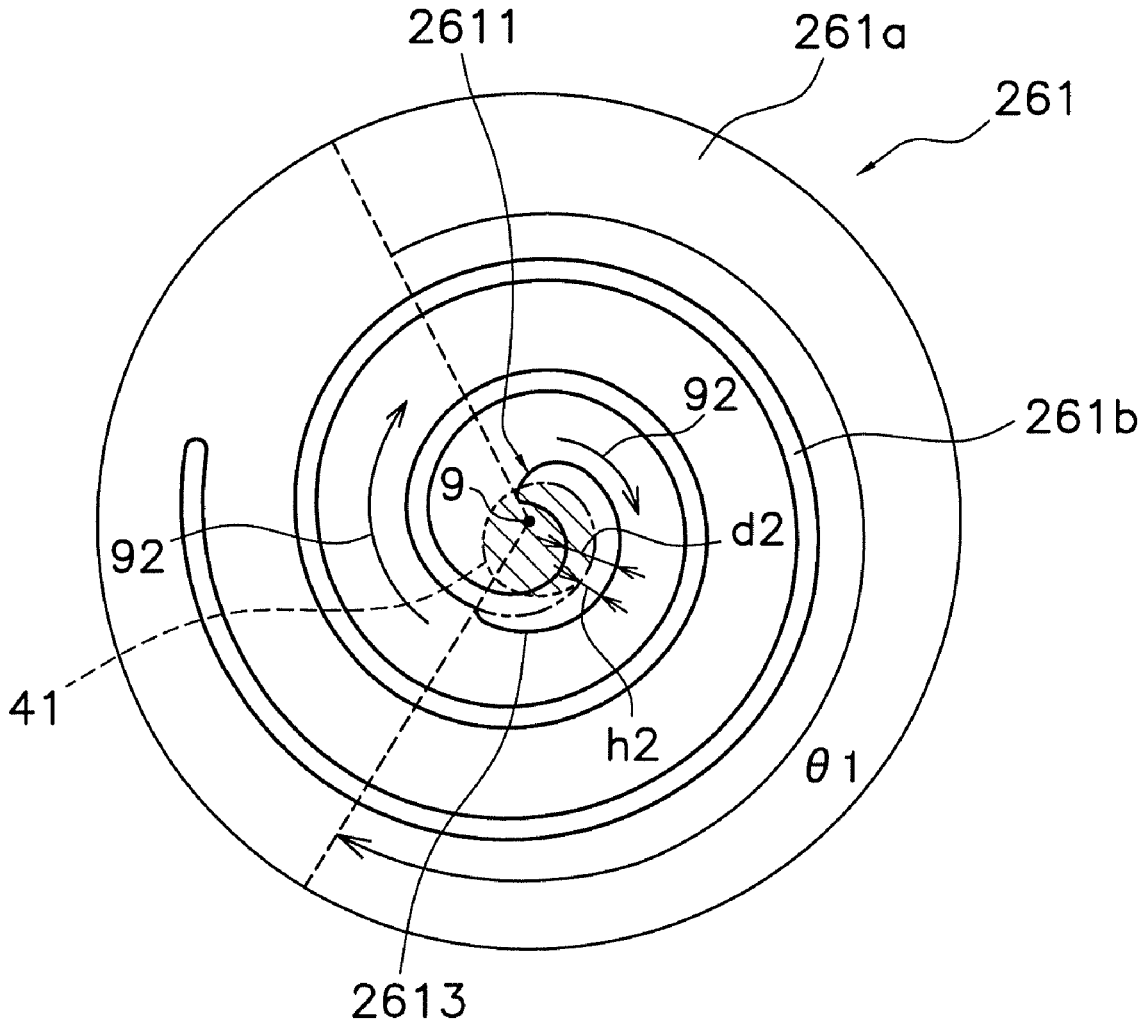
FIG. 3 is a drawing schematically depicting the iron casting 261 obtained in step (a).

FIGS. 2 and 3 schematically depict an iron casting 261 obtained in step (a). The iron casting 261 has a fixing part 261*a* and a spiraling part 261*b*. The spiraling part 261*b* is fixed to the fixing part 261*a* and extends in a spiraling formation around a center 9. In FIGS. 2 and 3, the shape of the spiraling part 261*b* obtained after step (b) is performed is shown by single-dashed lines.

In the iron casting 261 obtained in step (a), the dimension of a specified portion of the spiraling part 261*b* is greater than the dimension of this portion after step (b) is performed (Mode A).

Specifically, in a portion 2612 of an end 2611 of the spiral at the center 9 in FIG. 2, the thickness d1 is greater than the thickness h1 of the portion 2612 after step (b) is performed. In other words, in the aforementioned Mode A, the portion 2612 is used as the specified portion, and the thickness d1 of the portion 2612 is used as the dimension.

In the spiraling part 261*b* in FIG. 3, a portion 2613 extending around the center 9 from the end 2611 to a position located anywhere from a half circle (angle θ1=90°) up to a full circle (angle θ1=180°) has a thickness d2, which is greater than a thickness h2 of the portion 2613 after step (b) is performed. In other words, in the aforementioned Mode A, the portion 2613 is used as the specified portion, and the thickness d2 of the portion 2613 is used as the dimension. The angle θ1 is an angle formed around the center 9 by the direction 92 in which the spiral extends from the end 2611.

By performing step (b) on the iron casting 261 obtained in step (a), the panel 26*a* is obtained from the fixing part 261*a*, and the compression member 26*b* is obtained from the spiraling part 261*b*.

According to this method for manufacturing an orbiting scroll, the dimensions d1, d2 of the portions 2612, 2613 of the end 2611 at the center 9 of the spiral in step (a) are made to be greater than the dimensions h1, h2 of the portions 2612, 2613 after step (b) is performed, thereby increasing the heat capacity of the end portions 2612, 2613 where stress is readily concentrated. These portions 2612, 2613 are consequently more resistant to cooling even after being formed. The hardness of the portions 2612, 2613 can thereby be increased, and wear in the orbiting scroll 26 can thereby be reduced.

The portion 2613 after step (b) is performed encircles the hole 41 formed in the fixed scroll 24 when the orbiting scroll 26 is incorporated into the compression mechanism 15, as shown in FIG. 3. In FIG. 3, the position of the hole 41 is shown by dashed lines. Stress readily concentrates in the compression member 26*b* near the hole 41, but wear in the orbiting scroll 26 is reduced because the portion 2613 is high in hardness.

Figure 4:
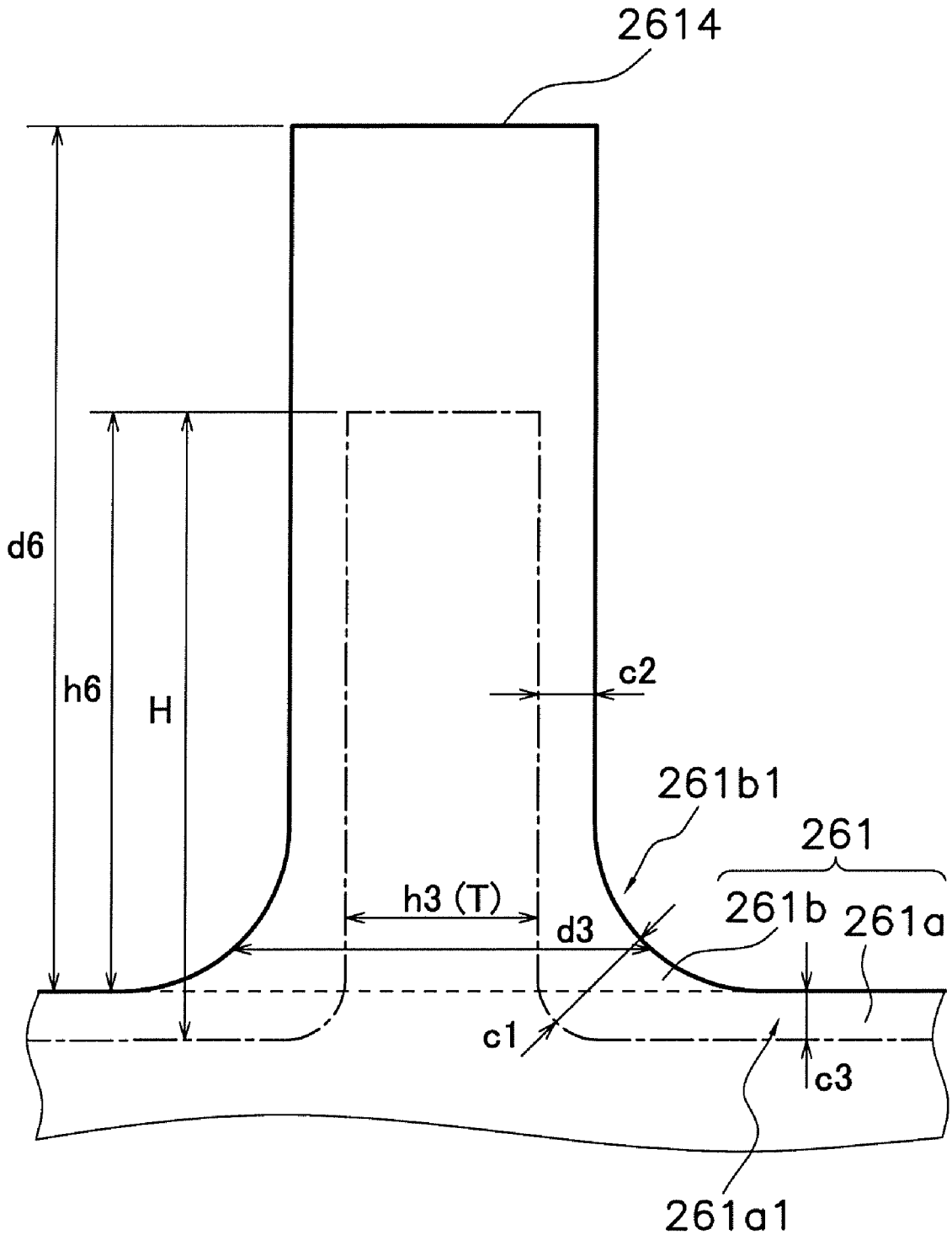
FIG. 4 is a drawing schematically depicting a cross-section of the iron casting 261 obtained in step (a).
Figure 5:
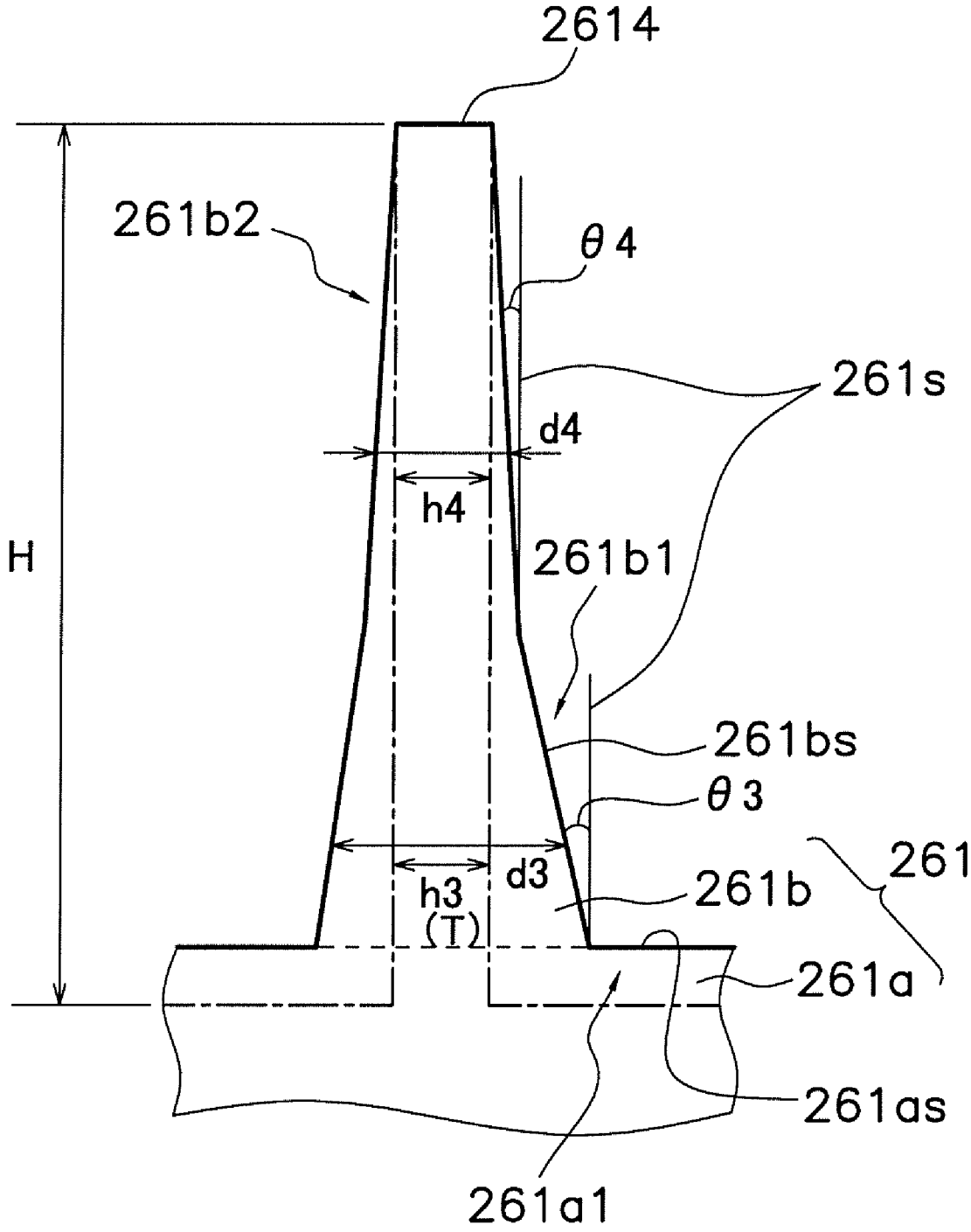
FIG. 5 is a drawing schematically depicting a cross-section of the iron casting 261 obtained in step (a).

FIGS. 4 and 5 schematically depict cross sections along the direction 91 of part of the fixing part 261*a* and spiraling part 261*b* of the iron casting 261 obtained in step (a). In FIGS. 4 and 5, the shape of the iron casting 261, i.e., of the orbiting scroll 26 obtained by performing step (b) is shown by single-dashed lines.

In the spiraling part 261*b* in FIGS. 4 and 5, the thickness d3 of the base portion 261*b*1 fixed to the fixing part 261*a* is greater than the thickness h3 of the portion 261*b*1 after step (b) is performed. Specifically, in the aforementioned Mode A, the base portion 261*b*1 is used as the specified portion, and the thickness d3 of the base portion 261*b*1 is used as the dimension.

This shape of the spiraling part 261*b* results in increased heat capacity in the base portion 261*b*1 where stress readily concentrates. Consequently, the base portion 261*b*1 is resistant to cooling even after being formed. The hardness of the base portion 261*b*1 can thereby be increased, and thereby deformation in the spiraling part 261*b* after being machined can be prevented.

For example, in the portions 2612, 2613 described above, the thickness d3 of the base portion can be made greater than the thickness h3.

In FIGS. 4 and 5, the thickness d3 of the base portion 261*b*1 decreases towards the distal end 2614 of the spiraling part 261*b* when seen from the fixing part 261*a*.

With this shape of the spiraling part 261*b*, in cases in which the iron casting 261 is formed using a metal die in step (a), the iron casting 261 can be easily removed from the metal die to the opposite direction of the distal end 2614. This is because friction between the metal die and the base portion 261*b*1 of the spiraling part 261*b* is reduced.

In FIGS. 4 and 5, not only in the base portion 261*b*1 but the thickness d4 of the portion 261*b*2 near the distal end 2614 is also greater than the thickness h4 after step (b) is performed.

With this shape of the spiraling part 261*b*, hardness can be increased not only in the base portion 261*b*1, but in the portion 261*b*2 near the distal end 2614 as well.

In FIG. 5, the thicknesses d3, d4 of the spiraling part 261*b* decrease towards the distal end 2614 from the base.

With this shape of the spiraling part 261*b*, since friction between the spiraling part 261*b* and the metal die is reduced, the iron casting 261 is readily removed from the metal die. Moreover, since the thickness d4 of the portion 261*b*2 near the distal end 2614 is small, the amount cut away in step (b) is smaller than the base portion 261*b*1, and thereby the iron casting 261 is readily machined.

Furthermore, in FIG. 5, the side surfaces 261*bs* of the spiraling part 261*b* are flat surfaces in both the base portion 261*b*1 and the portion 261*b*2 near the distal end 2614. The side surfaces of the base portion 261*b*1 are inclined with respect to the side surfaces of the portion 261*b*2 near the distal end 2614.

Specifically, the side surfaces of the base portion 261*b*1 are inclined at an angle θ3 with respect to a plane 261*s* perpendicular to the surface 261*as* of the fixing part 261*a*. The side surfaces of the portion 261*b*2 near the distal end 2614 are inclined at an angle θ4 with respect to the plane 261*s*. The angle θ3 is greater than the angle θ4.

With this shape of the spiraling part 261*b*, the side surfaces 261*bs* of the spiraling part 261*b* have a tapered shape, and the iron casting 261 is therefore readily removed from the metal die.

Returning to FIG. 4, the spiraling part 261*b* is greater in height d6 from the fixing part 261*a* than the height h6 after step (b) is performed.

With this shape of the spiraling part 261*b*, the hardness of the portion 261*b*2 near the distal end 2614 can also be increased. In the spiraling part 261*b* in FIG. 4, the thickness d3 of the base portion 261*b*1 and the height d6 of the spiraling part 261*b* are both greater than the thickness h3 and the height h6 after step (b) is performed, but it is also acceptable if, e.g., only either one of these dimensions is greater than the dimension after step (b) is performed.

For example, just the height d6 of the spiraling part 261*b* can be made greater than the height h6 after step (b) is performed. In other words, in Mode A described above, the height d6 of the spiraling part 261*b* can be used as the dimension.

In FIG. 4, all of the base portion 261*b*1, the portion 261*b*2 near the distal end 2614, and the portion 261*a*1 on the spiraling part 261*b* side of the fixing part 261*a* are cut. The thickness c1 at which the base portion 261*b*1 is cut is greater than both the thicknesses c2, c3 at which the portion 261*b*2 near the distal end 2614 and the portion 261*a*1 of the fixing part 261*a* are cut.

In the iron casting 261 obtained in step (a) in this mode, the dimension of the base portion 261*b*1 of the spiraling part 261*b* is designed to be greater than the dimensions of the portion 261*b*2 near the distal end 2614 and the portion 261*a*1 of the fixing part 261*a*. Consequently, the heat capacity of the base portion 261*b*1 can be made greater than the heat capacity of the other portions 261*b*2, 261*a*1, and thereby the hardness of the base portion 261*b*1 can be made higher than the other portions 261*b*2, 261*a*1.

Second Embodiment

Figure 6:
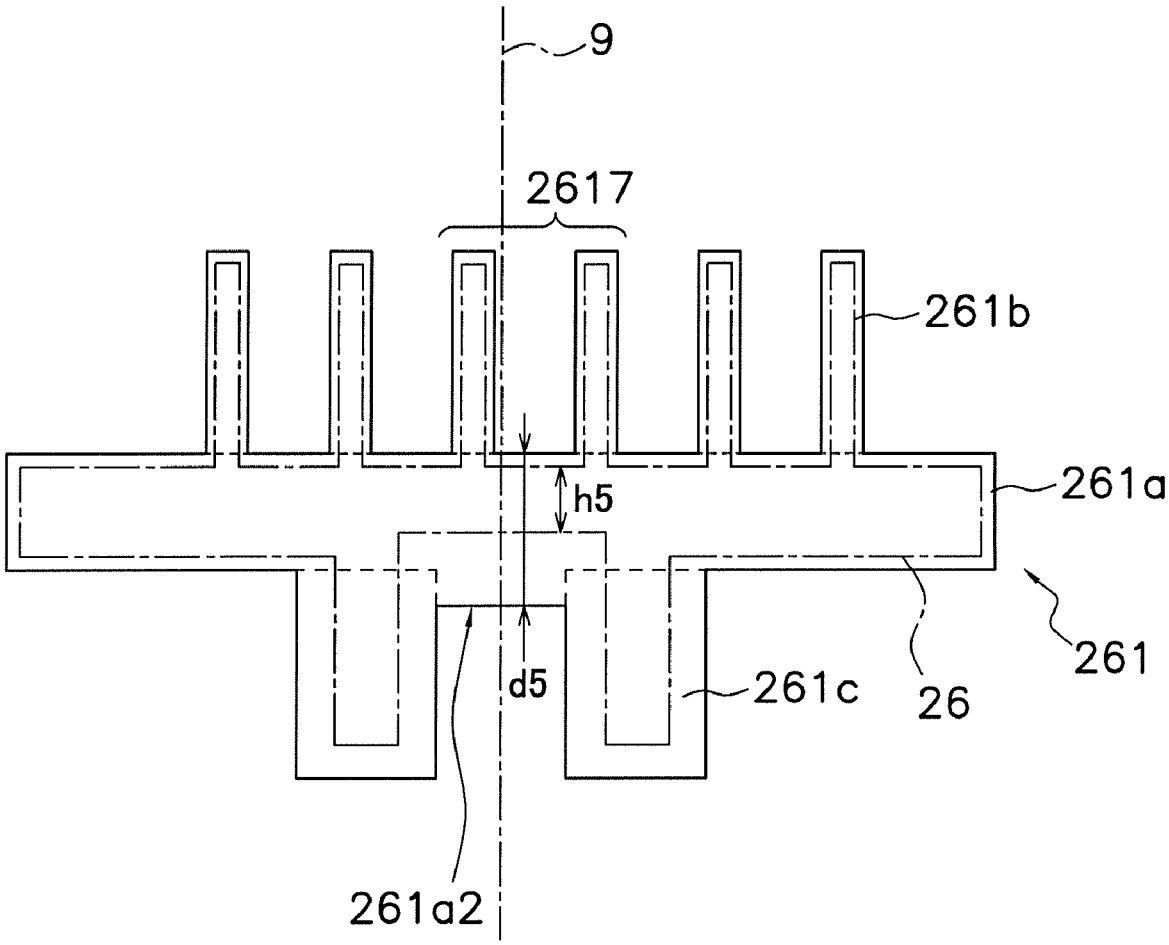
FIG. 6 is a drawing schematically depicting the iron casting 261 obtained in step (a).
Figure 7:
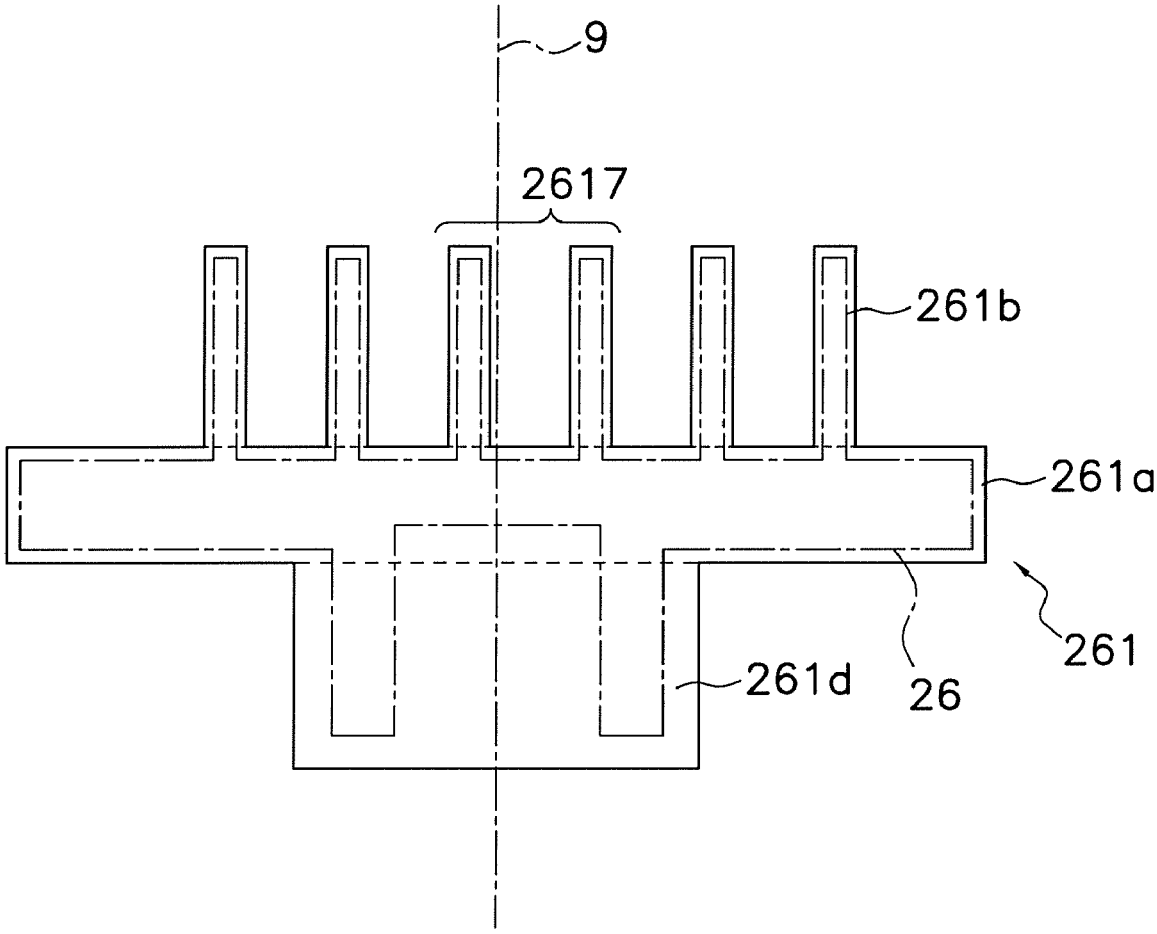
FIG. 7 is a drawing schematically depicting the iron casting 261 obtained in step (a).

The present embodiment also relates to a method for manufacturing an orbiting scroll 26 as a scroll member. This manufacturing method comprises a step (a) and a step (b), similar to the first embodiment. The difference from the first embodiment is in the shape of the iron casting 261 obtained in step (a). The shape of the iron casting 261 is described hereinbelow using FIGS. 6 and 7. In FIGS. 6 and 7, the shape of the iron casting 261 obtained by performing step (b) is shown by single-dashed lines.

In the fixing part 261*a* in FIG. 6, the thickness d5 of the portion 261*a*2 near the center 9 is greater than the thickness h5 of the portion 261*a*2 after step (b) is performed.

With this method for manufacturing the orbiting scroll 26, the heat capacity of the portion 261*a*2 of the fixing part 261*a* increases. Consequently, the portion 261*a*2 is resistant to cooling even after being formed, and thereby the portion 2617 in the spiraling part 261*b* near the center 9 is resistant to cooling. The hardness of the portion 2617 of the spiraling part 261*b* can thereby be increased, and wear in the orbiting scroll 26 can thereby be reduced.

In FIG. 6, the iron casting 261 further includes a protruding part 261*c*. The protruding part 261*c* is fixed to the fixing part 261*a* on the side opposite the spiraling part 261*b* and extends in a cylindrical shape in the direction opposite the spiraling part 261*b* from the edge of the portion 261*a*2 of the fixing part 261*a*.

The protruding part 261*c* machined in step (b) is used as the bearing 26*c* (FIG. 1), described hereinafter, in the orbiting scroll 26.

In FIG. 7, the iron casting 261 further includes a protruding part 261*d*. The protruding part 261*d* is fixed near the center 9 of the fixing part 261*a* on the side opposite the spiraling part 261*b*.

In step (b), the protruding part 261*d* is cut into a tube shape which opens only in the direction opposite the spiraling part 261*b*.

With this method for manufacturing the orbiting scroll 26, the protruding part 261*d* is also formed in step (a), whereby the iron casting 261 is thicker near the center 9. Consequently, the center 9 vicinity of the iron casting 261 is greater in heat capacity and more resistant to cooling even after being formed, and whereby the spiraling part 261*b* is also more resistant to cooling in the portion 2617 near the center 9. The hardness of the portion 2617 of the spiraling part 261*b* can thereby be increased, and wear in the orbiting scroll 26 can be reduced.

Moreover, the protruding part 261*d* machined in step (b) is used as the bearing 26*c* (FIG. 1), described hereinafter, in the orbiting scroll.

Third Embodiment

The method for manufacturing a fixed scroll 24 as a scroll member comprises a step (a) and a step (b), similar to the first embodiment.

Figure 8:
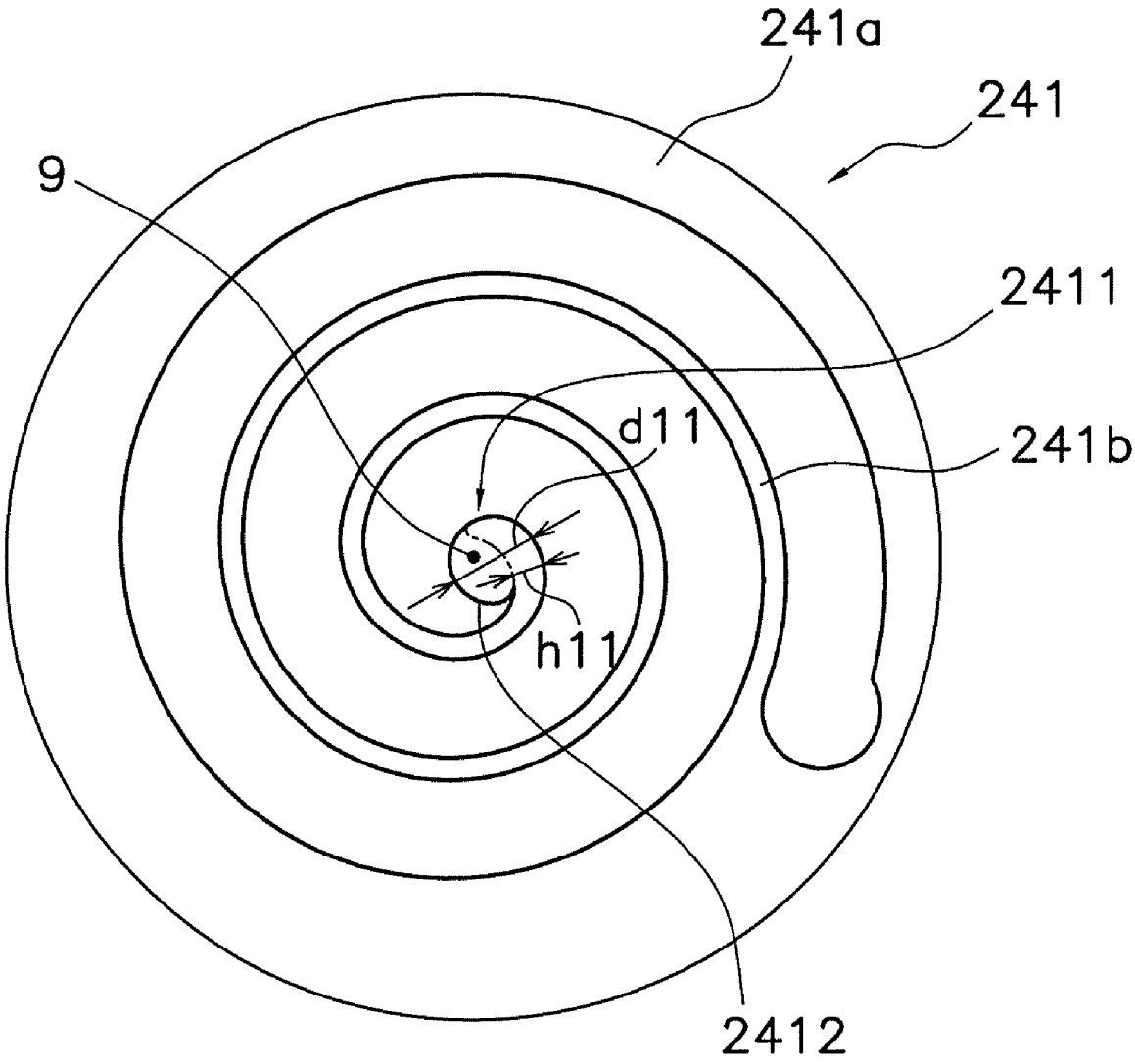
FIG. 8 is a drawing schematically depicting an iron casting 241 obtained in step (a).
Figure 9:
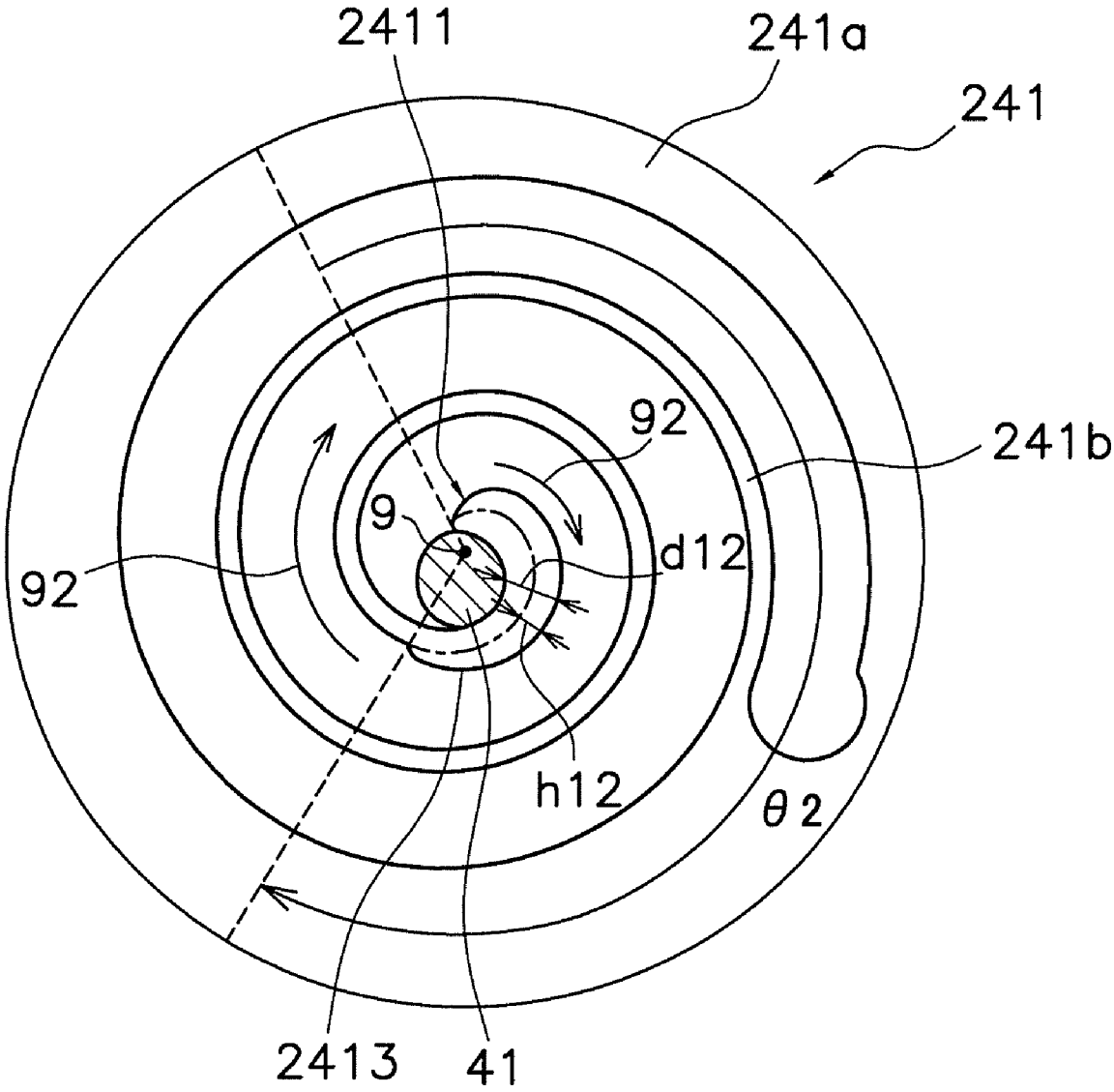
FIG. 9 is a drawing schematically depicting the iron casting 241 obtained in step (a).

FIGS. 8 and 9 schematically depict an iron casting 241 obtained in step (a) in the manufacture of the fixed scroll 24. The iron casting 241 has a fixing part 241*a* and a spiraling part 241*b*. The spiraling part 241*b* is fixed to the fixing part 241*a* and extends in a spiraling formation. In FIGS. 8 and 9, the shape of the spiraling part 241*b* obtained by performing step (b) is shown by single-dashed lines.

In the iron casting 241 obtained in step (a), the dimension of the specified portion of the spiraling part 241*b* is greater than the dimension of the same portion after step (b) is performed (Mode B), similar to the iron casting 261 shown in FIGS. 2 and 3.

Specifically, in FIG. 8, only in a portion 2412 of an end 2411 at the center 9 of the spiral, the thickness d11 is greater than the thickness h11 of the portion 2412 after step (b) is performed. Specifically, in the aforementioned Mode B, the portion 2412 is used as the specified portion, and the thickness d11 of the portion 2412 is used as the dimension.

In the spiraling part 241*b* in FIG. 9, a portion 2413 extending around the center 9 from the end 2411 up to a position located anywhere from a half circle (angle $\theta 2=90°$) to a full circle (angle $\theta 2=180°$) has a thickness d12 greater than a thickness h12 of the portion 2413 after step (b) is performed. Specifically, in the aforementioned Mode B, the portion 2413 is used as the specified portion, and the thickness d12 of the portion 2413 is used as the dimension. Herein, the angle $\theta 2$ is the angle formed by the direction 92 in which the spiral extends from the end 2411 around the center 9.

By performing step (b) on the iron casting 241 obtained in step (a), a panel 24*a* is obtained from the fixing part 241*a*, and a compression member 24*b* is obtained from the spiraling part 241*b*.

With this method for manufacturing the fixed scroll 24, heat capacity is greater in the portions 2412, 2413 of the ends where stress readily concentrates, and the hardness of the portions 2612, 2613 can be increased, similar to the method for manufacturing the orbiting scroll 26 described in the first embodiment. Consequently, wear in the fixed scroll 24 can be reduced.

The portion 2413 after step (b) is performed encircles a hole 41, as shown in FIG. 9. Stress readily concentrates in the compression member 24*b* near the hole 41, but since the portion 2413 has high hardness, wear in the fixed scroll 24 is reduced.

Also in the method for manufacturing the fixed scroll 24, the shape shown in FIGS. 4 and 5 is used in the spiraling part 241*b*, whereby the same effects as those described in the first embodiment are obtained.

In the fixing part 241*a*, the thickness of the portion near the center 9 in the fixing part 241*a* is increased, similar to the second embodiment, whereby hardness can be increased in the portion of the spiraling part 241*b* near the center 9.

Fourth Embodiment

An orbiting scroll 26 manufactured by either one of the methods in the first and second embodiments will be described.

Figure 10:
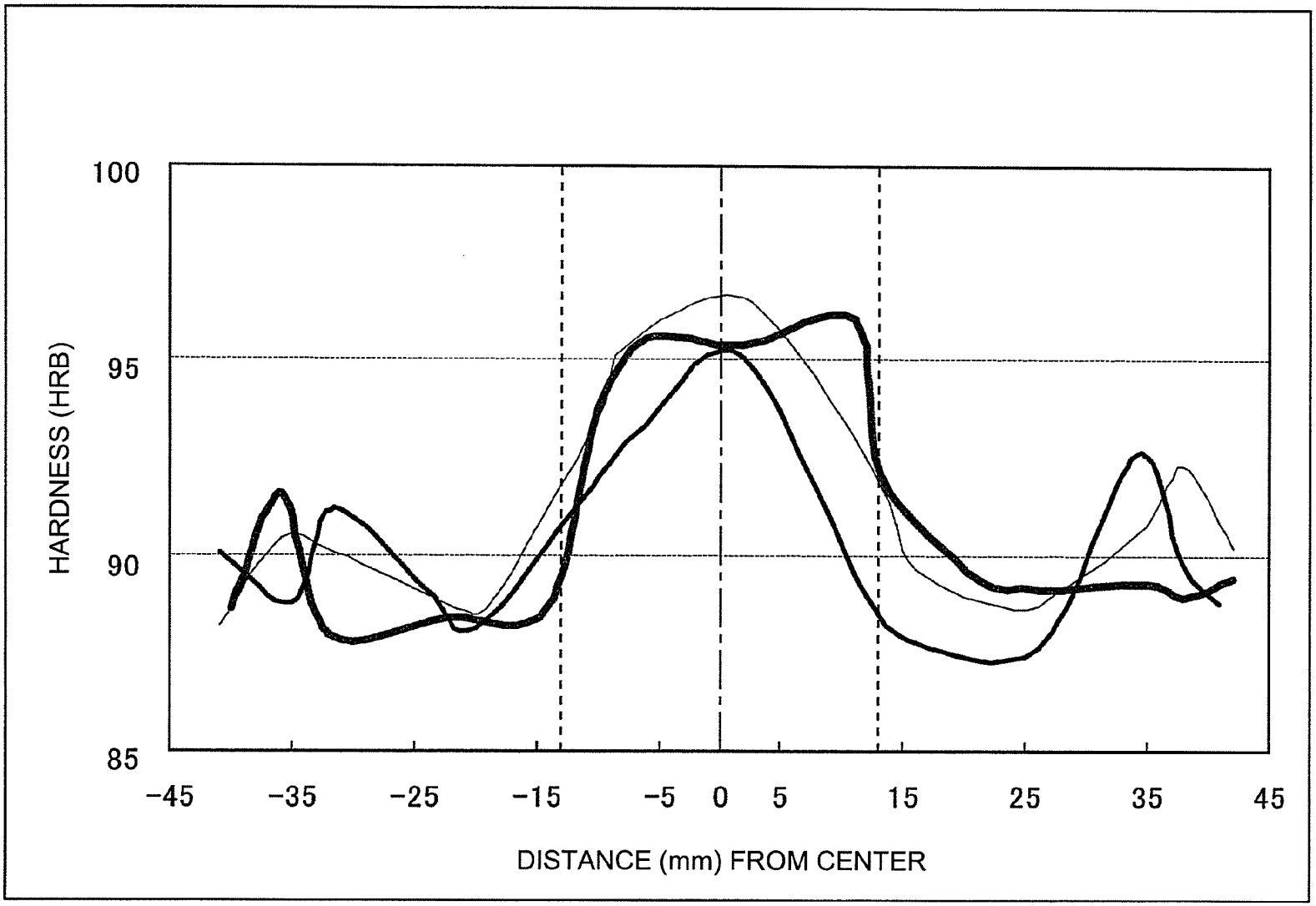
FIG. 10 is a diagram using a graph to show the relationship between the distance from a center 9 and the hardness of a base portion.

FIG. 10 uses a graph to show the relationship between distance from the center 9 and hardness of the base portion in a compression member 26*b* of the orbiting scroll 26 obtained by performing step (b). In FIG. 10, the position of the outside edge of the bearing 26*c* (FIG. 1) is shown by a single-dashed line.

According to the graph shown in FIG. 10, using the manufacturing methods of the first and second embodiments makes it possible to increase the hardness of the base portion of the compression member 26*b* to HRB 95 or greater near the center 9, i.e., farther inward than the outside edges of the bearing 26*c*.

Consequently, in the vicinity of the center 9, the compression member 26*b* does not readily deform even if the ratio H/T of the height H of the compression member 26*b* from the panel 26*a* (FIGS. 4 and 5) with respect to the thickness T of the compression member 26*b* (FIGS. 4 and 5) equals to or exceeds 8.5. The orbiting scroll 26 can be reduced in size if the orbiting scroll 26 is designed using the ratio H/T.

Wear and deformation do not readily occur in the orbiting scroll 26 manufactured by the methods according to the first and second embodiments. Consequently, failure of the compression mechanism 15 can be reduced by using the orbiting scroll 26 as a scroll member of the compression mechanism 15.

Also in the fixed scroll 24 manufactured using the method according to the third embodiment, a compression member 24*b* having a degree of hardness similar to that of the orbiting scroll 26 is obtained. Consequently, the ratio H/T of the height H of the compression member 24*b* to the thickness T can be 8.5 or greater.

Moreover, the fixed scroll 24 is not likely to undergo wear or deformation. Consequently, failure of the compression mechanism 15 can be reduced by using the fixed scroll 24 as a scroll member of the compression mechanism 15.

Working Examples

<Structure of Scroll Compressor>

The structure of the scroll compressor 1 will be described in greater detail using FIG. 1. In addition to the case 11 and the compression mechanism 15, the scroll compressor 1 comprises an Oldham ring 2, a fixing member 12, a motor 16, a crankshaft 17, a suction pipe 19, a discharge pipe 20, and a bearing 60.

The case 11 has a cylindrical shape and extends along the direction 91. The Oldham ring 2, the fixing member 12, the motor 16, the crankshaft 17, and the bearing 60 are housed within the case 11.

The motor 16 has a stator 51 and a rotor 52. The stator 51 is annular in shape and is fixed to an internal wall 11*a* of the case 11. The rotor 52 is provided to the inner periphery side of the stator 51 and is made to face the stator 51 with an air gap.

The crankshaft 17 extends along the direction 91 and has a main shaft 17*a* and an eccentric part 17*b*. The main shaft 17*a* is a portion that rotates around a rotational axis 90 and is connected to the rotor 52. The eccentric part 17*b* is a portion disposed with being eccentric from the rotational axis 90, and is connected to the upper side of the main shaft 17*a*. The lower end of the crankshaft 17 is slidably supported by the bearing 60.

The fixed member 12 is specifically a housing in FIG. 1, and is fitted without any gaps into the internal wall 11*a* of the case 11. The fixed member 12 is fitted into the internal wall 11*a* by, e.g., press fitting, shrink fitting, or another method. The fixed member 12 may be fitted into the internal wall 11*a* via a seal.

Since the fixed member 12 is fitted into the internal wall 11*a* without gaps, a space 28 positioned on the underside of the fixed member 12 and a space 29 positioned on the top side are partitioned without any gaps. Consequently, the fixed member 12 is capable of maintaining pressure differences that occur between the space 28 and the space 29. The pressure in the space 28 is high, and the pressure in the space 29 is low.

A hollow 31 opened in the top side of the fixed member 12 is provided in the vicinity of the rotational axis 90. The eccentric part 17*b* of the crankshaft 17 is accommodated within the hollow 31. Furthermore, the fixed member 12 has a bearing 32 and a hole 33. The bearing 32 supports the main shaft 17*a* while the main shaft 17*a* of the crankshaft 17 is in a state of being inserted through the hole 33.

The surface on the top side of the fixed scroll 24 has a concavity. A space 45 enclosed by a portion 42 in this surface having the concavity is closed by a lid 44. The lid 44 partitions two spaces of different pressures; i.e., the space 45 and the space 29 on the top side.

The orbiting scroll 26 further comprises a bearing 26*c*. The bearing 26*c* is linked to the underside of the panel 26*a*, and the bearing 26*c* slidably supports the eccentric part 17*b* of the crankshaft 17.

<Flow of Refrigerant>

The flow of refrigerant through the scroll compressor 1 will be described using FIG. 1. In FIG. 1, the flow of refrigerant is depicted by arrows. Refrigerant is sucked in through the suction pipe 19 and is led into the compression chamber (space 40) of the compression mechanism 15. The refrigerant compressed by the compression chamber (space 40) is discharged out to the space 45 through a discharge hole 41 provided near the center of the fixed scroll 24. Consequently, the pressure in the space 45 is high. Conversely, the pressure in the space 29 partitioned from the space 45 by the lid 44 remains low.

The refrigerant in the space 45 flows sequentially through a hole 46 provided in the fixed scroll 24 and a hole 48 provided in the fixed member 12 in this order, and then flows into the space 28 below the fixed member 12. The refrigerant in the space 28 is directed into a gap 55 by a guiding plate 58. The gap 55 is herein provided between the case 11 and part of the side surface of the stator 51.

The refrigerant that has flowed through the gap 55 to the space below the motor 16 then flows through an air gap or a gap 56 in the motor 16, and then flows into the discharge pipe 20. The gap 56 is herein provided between the case 11 and another part of the side surface of the stator 51.

INDUSTRIAL APPLICABILITY

The present invention can be widely applied to the field of scroll members and their manufacturing methods.

What is claimed is:

1. A method of manufacturing a scroll member for a compression mechanism installed in a scroll compressor, the method comprising:

a casting step including forming an iron casting including a spiraling part extending in a spiraling formation and a fixing part with the spiraling part extending from a first side thereof; and a cutting step including cutting the iron casting obtained in the casting step in order to obtain a final shape of the scroll member, the iron casting obtained in the casting step having a height of the spiraling part, measured from the first side of the fixing part in a specified portion of the spiraling part, that is greater before the cutting step is performed than after the cutting step is performed, and the specified portion being positioned at least at an end in a center side of the spiraling formation.

2. The method for manufacturing a scroll member according to claim 1, wherein the specified portion of the spiraling part extends from 180 to 360 degrees around the center from the end of the spiraling portion.

3. The method for manufacturing a scroll member according to claim 1, wherein the compression mechanism includes an orbiting scroll and a fixed scroll provided with a central hole; and the scroll member is configured to be used as the orbiting scroll, with the specified portion encircling the hole of the fixed scroll after the cutting step is performed and when the orbiting scroll has been incorporated into the compression mechanism with the fixed scroll.

4. The method for manufacturing a scroll member according to claim 1, wherein the compression mechanism includes an orbiting scroll and a fixed scroll provided with a central hole;

the scroll member includes the central hole, which is created during at least one of the casting and cutting steps such that the scroll member is configured to be used as the fixed scroll, with the specified portion encircling the central hole after the cutting step is performed and when the fixed scroll has been incorporated into the compression mechanism with the orbiting scroll.

5. The method for manufacturing a scroll member according to claim 1, wherein the iron casting is formed by semi-molten die casting in the casting step.

6. The method for manufacturing a scroll member according to claim 1, wherein the iron casting obtained in the casting step has a thickness in a central portion of the spiraling part that is greater than a thickness in the other portion except the central portion of the spiraling part.

7. The method for manufacturing a scroll member according to claim 1, wherein the iron casting obtained in the casting step has the height of the spiraling part that is at least a fourth greater before the cutting step is performed than after the cutting step is performed.

8. The method for manufacturing a scroll member according to claim 1, wherein the iron casting obtained in the casting step has a thickness of the specified portion of the spiraling part that is greater before the cutting step is performed than after the cutting step is performed.

9. The method for manufacturing a scroll member according to claim 8, wherein a base thickness of the specified portion at a base portion thereof that is fixed to the fixing part is greater before the cutting step is performed than after the cutting step is performed.

10. The method for manufacturing a scroll member according to claim 9, wherein the base portion of the specified portion, a distal portion of the specified portion, and the first side of the fixing part are all cut when the cutting step is performed; and more material thickness is cut from the base portion than is cut from the distal portion and the first side of the fixing part as measured in thickness directions of the distal portion and the fixing part.

11. The method for manufacturing a scroll member according to claim 9, wherein the base thickness of the specified portion at the base portion decreases as the specified portion extends towards a distal end of the spiraling part before the cutting step is performed.

12. The method for manufacturing a scroll member according to claim 11, wherein a distal portion of the specified portion has a distal thickness that is also greater before the cutting step is performed than after the cutting step is performed.

13. The method for manufacturing a scroll member according to claim 12, wherein a side surface of the spiraling part is a flat surface formed in both the base portion and the distal portion before the cutting step is performed; and the side surface extending along the base portion is inclined with respect to the side surface extending along the distal portion before the cutting step is performed.

* * * * *